US005803771A

United States Patent [19]

Knapp

[11] Patent Number: 5,803,771

[45] Date of Patent: Sep. 8, 1998

[54] ELECTRICAL CONNECTOR THAT MINIMIZES BENT PINS

[75] Inventor: Donald Lee Knapp, Pasadena, Md.

[73] Assignee: The United States of America as represented by the Director National Security Agency, Washington, D.C.

[21] Appl. No.: 655,014

[22] Filed: May 29, 1996

[51] Int. Cl.[6] ..... H01R 13/10

[52] U.S. Cl. ..... 439/682; 439/381; 439/931

[58] Field of Search ..... 439/374, 380, 439/381, 660, 682, 931

[56] References Cited

U.S. PATENT DOCUMENTS

| | | | |
|---|---|---|---|
| 1,745,233 | 1/1930 | Schutt | 439/381 |
| 4,997,376 | 3/1991 | Buck et al. | 439/59 |
| 5,147,209 | 9/1992 | Litwin et al. | 439/931 X |
| 5,259,776 | 11/1993 | Giroux | 439/188 |
| 5,472,348 | 12/1995 | Daly et al. | 439/76.1 |

*Primary Examiner*—Khiem Nguyen
*Attorney, Agent, or Firm*—Robert D. Morelli

[57] ABSTRACT

A female portion of an electrical connector that minimizes bending of electrical connector pins that are inserted therein by eliminating all flat surfaces on the face of the connector that meets the inserting pins. The connector has only curved surfaces on the face of the connector that meets the pins. The curved surfaces are created by opening holes in the connector that are wider than required for the pins. The holes are then tapered down to a size that snugly accommodates the pins. At the end of the taper, a hole, or shaft, extends through the connector so that the pins are accommodated snugly. The shaft is clad with conductive material so that the connector makes electrical contact with the pins.

9 Claims, 4 Drawing Sheets

ELECTRICAL CONNECTOR THAT MINIMIZES BENT PINS

FIELD OF THE INVENTION

This invention relates to electrical connectors and, more particularly, to the female portion of an electrical connectors that minimizes bent pins.

BACKGROUND OF THE INVENTION

In 1989, thirty companies formed an organization called the Personal Computer Memory Card International Association (PCMCIA). This association was created to develop an interface specification to add peripheral components such as additional memory, modems, hard-drives, local area network (LAN) adapters, multimedia interface specifications etc. to lap-top computers. The Association published a specification (i.e., PCMCIA Standard Release 1.0) in June of 1990 which defines an interface for a 68-pin device that is the size of a credit card. The standard has been expanded several times with the latest release made in February of 1995 (i.e., the Personal Computer (PC) Card Standard). The Association has grown to over 500 members. Each revision of the standard has added capabilities and flexibilities while maintaining the original 68-pin configuration. PCMCIA cards that follow the 68-pin standard are widely available.

The female portion, or card-side, of the connector consists of 68 open sockets, or holes, that can accept connector pins. PCMCIA cards have become very popular and are being used widely.

The current design of a female portion of a connector includes a flat surface between each hole in the connector. Pins on a host connector may be bent if insertion of a PCMCIA card into the host connector is attempted while the pins in the host connector are misaligned with the PCMCIA card. A host connector may be quite expensive to replace due to its placement inside of a computer and the labor costs associated with its removal. Furthermore, bent pins on host connectors are becoming increasingly common due to the widespread use of the PCMCIA cards.

U.S. Pat. Nos. 4,997,376, entitled "PAIRED CONTACT ELECTRICAL CONNECTOR SYSTEM"; 5,259,776, entitled "FULLY PROGRAMMABLE DIN CONNECTOR"; and 5,472,348, entitled "PLUGGABLE MALE TERMINATOR" each disclose a female portion of a connector that includes flat surfaces between the holes in the female portion of the connector. These flat surfaces may cause pin bending in a host connector if insertion of a PCMCIA card is attempted while the pins of the host connector are misaligned with the PCMCIA card. The present invention minimizes pin bending by eliminating all flat surfaces in the female portion of a connector that could come in contact with pins that are inserted into the connector.

SUMMARY OF THE INVENTION

It is an object of the present invention to create a female portion of an electrical connector that minimizes the bending of pins that are inserted into the connector.

It is another object of the present invention to create a female portion of an electrical connector that minimizes the bending of pins that are inserted into the connector by eliminating all flat surfaces that may come in contact with the pins.

It is another object of the present invention to create a female portion of an electrical connector that minimizes the bending of pins that are inserted into the connector by eliminating all flat surfaces that may come in contact with the pins and expanding the opening of each hole in the connector so that the holes nearly touch each other.

It is another object of the present invention to create a female portion of an electrical connector that minimizes the bending of pins that are inserted into the connector by eliminating all flat surfaces that may come in contact with the pins, expanding the surface opening of each hole in the connector so that the holes nearly touch each other, and tapering each hole in the connector down to a diameter that can snugly accept an electrical pin.

The objects of the present invention are achieved by eliminating all flat surfaces that may come in contact with electrical pins that are inserted into the connector. The present invention uses a 68 pin PCMCIA card as an example, but the present invention applies to all possible configurations of the female portion of an electrical connector.

The surface openings in the connector are expanded to eliminate all flat surfaces on the face of the connector that may come in contact with insertion pins. The expanded holes create curved, or rounded, surfaces instead of flat surfaces. If a pin is misaligned, it will slide along a curved surface to the correct position rather than being bent by hitting a flat surface. The internal diameter of the holes in the connector are smaller than the diameter of the expanded surface holes so that the connector may accept standard electrical pins. Because of this mismatch is hole diameters, the area between the surface hole and the internal hole is tapered. The tapering may be four-sided or conical. The diameter of the surface opening and the angle of taper may be varied to achieve a wide range of surface curvatures and tapering slopes.

The present invention eliminates pin bending even if the insertion pins are misaligned as much as half the distance between holes.

DETAILED DESCRIPTION

Figure 1:
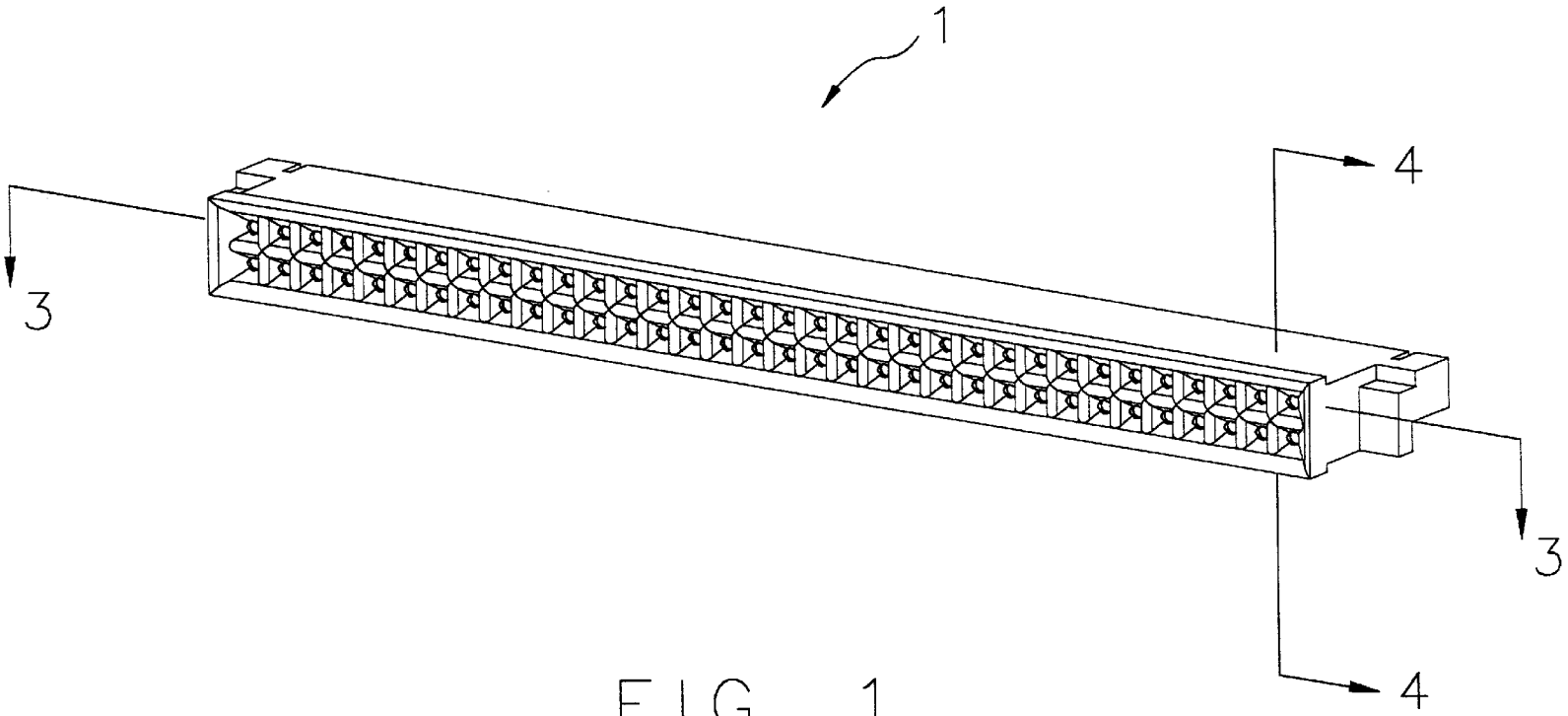
FIG. 1 is a perspective view of the present invention.

FIG. 1 is a perspective view of the present invention which is a female portion of an electrical connector 1. The present invention solves the immediate problem of pin bending in a PCMCIA card whenever an attempt is made to insert a PCMCIA card into a female portion of an electrical connector while the pins are misaligned to the female connector. FIG. 1 illustrates a configuration of the present invention that meets the PCMCIA 68-pin standard, but the scope of the present invention is broad enough to include female electrical connectors of any configuration and dimension.

Figure 2:
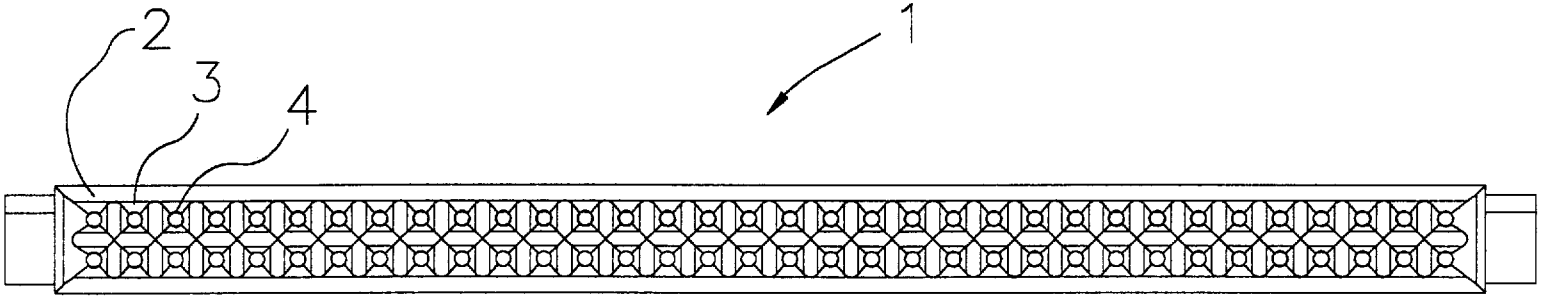
FIG. 2 is top view of the present invention.

FIG. 2 is a top view of the female connector 1 in the configuration of a 68-pin PCMCIA connector. FIG. 2 shows the hole openings 2 in the female connector 1. About the only detail that can be seen in this top view is that the diameter of the surface opening 3 is larger that the diameter of the internal opening 4. The novelty of the present invention is best seem in the section views of the female connector 1 discussed below.

Figure 3:
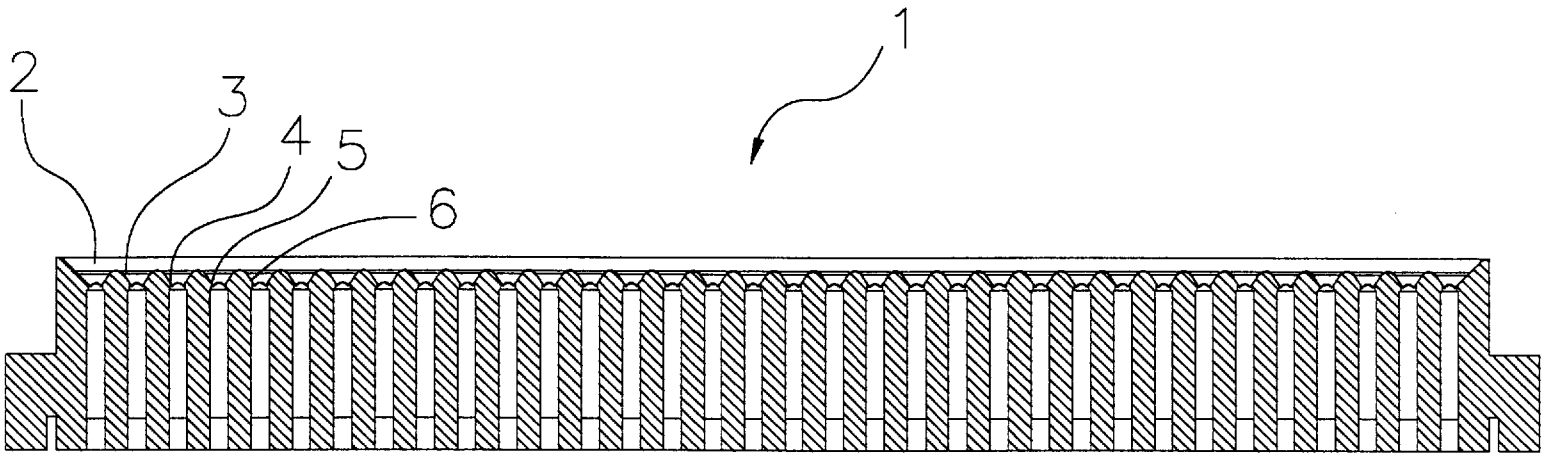
FIG. 3 is a front section taken along line 3—3 of FIG. 1 illustrating the elimination of all flat surfaces that may come in contact with insertion pins.

FIG. 3 is a front section view of the female connector 1 taken along line 3—3 in FIG. 1. Each hole opening 2 is larger than is required to accept an electrical pin according to the 68-pin PCMCIA standard. Therefore, two diameters are created in the female connector 1. That is, a larger diameter surface opening 3 for each hole in the female connector 1 and a smaller diameter internal opening 4 between the top and the bottom of the female connector 1. The larger diameter surface opening 3 may come in contact first with an insertion pin (not shown). The smaller diameter internal opening 4 is the eventual end point for an insertion pin.

The female connector 1 is made of an insulating, or dielectric, material such as plastic, ceramic, or any other suitable insulating material while the smaller diameter internal opening 4 is clad with conductive material 5 such as copper, gold, aluminum, or any other suitable conductive material.

The larger diameter surface opening 3 is such that no flat surface exists at the interface between the female connector 1 and the insertion pins. Only curved, or rounded, surfaces may come in contact with the insertion pins. The diameter of the surface opening 3 may be varied to achieve a wide range of curvature, or rounding, between hole openings 2.

To resolve the difference between the larger diameter surface opening 3 and the smaller diameter internal opening 4, the space between these two openings 6 is tapered. The tapering may be accomplished by any suitable tapering method. For example, the tapering may be four-sided as illustrated in FIG. 2. That is, the surface opening 3 tapers down to the internal opening 4 on four sides so that four slopes are created (i.e., a north, south, east, and west slope). A surface exists at the junction between any two of these slopes, but the surface is not flat. The resulting four surfaces are straight slopes that do not cause pin bending. The tapering may also be conical. The angle of taper may be varied to achieve a wide range of taper angles.

If a pin is misaligned during insertion into the female connector 1, the pin will slide along the curved, or rounded, larger diameter surface opening 3 of the pin hole 2 rather than bend against a flat surface between the pin holes of a prior art female connector. The pin will then align itself with the smaller diameter internal opening 4 as it slides down the tapered side 6 of the hole 2 in the female connector 1. It is believed that the present invention eliminates pin bending even if the insertion pins are misaligned as much as half the distance between holes 2 in the female connector 1.

Figure 4:
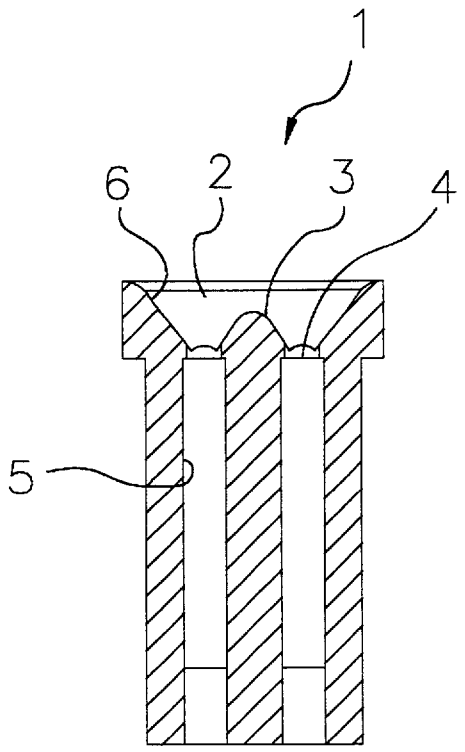
FIG. 4 is a side section taken along line 4—4 of FIG. 1.

FIG. 4 is a side section view of the female connector 1 taken along line 4—4 in FIG. 1. This view shows the double row of pins as required by the 68-pin PCMCIA standard. This double rowed configuration is for illustration purposes only. The scope of the claims of the present invention are believed to be broad enough to include female electrical connectors of any configuration and dimension.

What is claimed is:

1. A female portion of an electrical connector, comprising:

(a) a dielectric housing having a top and a bottom, having one or more hole openings in the top, where each hole opening is comprised of:

(i) a surface opening in the top having a diameter greater than a pin that may be inserted into the connector so that only non-flat surfaces exist in the top of the housing, where the surface opening tapers down in single-angle fashion to an internal opening between the top and the bottom of the housing, where the internal opening will accommodate the pin snugly, where the internal opening has a diameter that is smaller than the diameter of the surface opening, where the internal opening extends to the bottom of the housing, and where the internal opening is clad with conductive material.

2. The device of claim 1, wherein said dielectric housing is constructed of a material selected from the group consisting of plastic and ceramic.

3. The device of claim 1, wherein said surface opening tapers down to said internal opening so that four slanted surfaces are created.

4. The device of claim 1, wherein said surface opening tapers down to said internal opening in conical fashion.

5. The device of claim 1, wherein said conductive material is selected from the group consisting of copper, gold, and aluminum.

6. The device of claim 1, wherein said connector is configured as a 68-pin connector for accepting a 68-pin PCMCIA card.

7. The device of claim 2, wherein said surface opening tapers down to said internal opening so that four slanted surfaces are created.

8. The device of claim 7, wherein said conductive material is selected from the group consisting of copper, gold, and aluminum.

9. The device of claim 8, wherein said connector is configured as a 68-pin connector for accepting a 68-pin PCMCIA card.

* * * * *